US009391357B2

(12) United States Patent
Ishida

(10) Patent No.: US 9,391,357 B2
(45) Date of Patent: Jul. 12, 2016

(54) ELECTRONIC APPARATUS

(71) Applicant: Sony Corporation, Tokyo (JP)

(72) Inventor: Tatsuya Ishida, Nagano (JP)

(73) Assignee: SONY CORPORATION, Tokyo (JP)

( * ) Notice: Subject to any disclaimer, the term of this patent is extended or adjusted under 35 U.S.C. 154(b) by 732 days.

(21) Appl. No.: 13/660,040

(22) Filed: Oct. 25, 2012

(65) Prior Publication Data

US 2013/0106662 A1 May 2, 2013

(30) Foreign Application Priority Data

Nov. 1, 2011 (JP) ..... 2011-240120

(51) Int. Cl.
*H01Q 1/24* (2006.01)
*H01Q 1/22* (2006.01)
*H01Q 1/44* (2006.01)

(52) U.S. Cl.
CPC ..... *H01Q 1/2266* (2013.01); *H01Q 1/243* (2013.01); *H01Q 1/44* (2013.01)

(58) Field of Classification Search
CPC ..... H01Q 1/243
USPC ..... 343/702
See application file for complete search history.

(56) References Cited

FOREIGN PATENT DOCUMENTS

JP 2009-135586 6/2009

*Primary Examiner* — Graham Smith
(74) *Attorney, Agent, or Firm* — Frommer Lawrence & Haug LLP; William S. Frommer

(57) ABSTRACT

Provided is an electronic apparatus including a casing that is formed of a non-conductive material and is configured such that a hole is formed in a part of the casing, an antenna element that is formed on an outer surface of the casing, a logo mark that is configured such that at least a part thereof is formed of a conductor to be disposed to cover the hole of the casing, a part of a conductor portion comes into contact with the antenna element, and another part of the conductor portion is exposed to the hole of the casing, and a feeding wire that is connected to the logo mark through the hole formed in the casing.

2 Claims, 9 Drawing Sheets

ELECTRONIC APPARATUS

BACKGROUND

The present disclosure relates to an electronic apparatus.

In recent years, electronic apparatuses on which a miniaturized antenna such as a planar antenna or a monopole antenna is mounted on the outer surface of a casing have been put to practical use. For example, Japanese Unexamined Patent Application Publication No. 2009-135586 discloses a technology for forming an aluminum-deposited metal layer on the outer surface of a casing and using the metal layer as an antenna element. When the antenna element is formed on the outer surface of the casing, it is necessary to ensure a feeding path from a power source disposed inside the casing to the antenna element. Japanese Unexamined Patent Application Publication No. 2009-135586 discloses a configuration in which an insert nut formed through the casing is provided and power is fed from the power source disposed inside the casing to the antenna element through the insert nut.

SUMMARY

However, when the insert nut is used, it is difficult to decorate the surface of the casing corresponding to a portion in which the insert nut is formed. Further, when the insert nut is formed to ensure the feeding path, the number of elements may increase and a manufacturing process may become complicated, and therefore the manufacturing cost may increase. Furthermore, even when a feeding path is formed in an antenna element using a metal plate, a bolt, or the like, it is necessary to configure a structure for hiding such a connection member from the outside of the casing to improve the appearance. Accordingly, it is desirable to provide a novel and improved electronic apparatus capable of reducing a manufacturing cost without deterioration in the appearance of an antenna portion.

According to an embodiment of the present disclosure, there is provided an electronic apparatus including: a casing that is formed of a non-conductive material and is configured such that a hole is formed in a part of the casing; an antenna element that is formed on an outer surface of the casing; a logo mark that is configured such that at least a part thereof is formed of a conductor and the logo mark is disposed to cover the hole of the casing, a part of a conductor portion comes into contact with the antenna element, and another part of the conductor portion is exposed to the hole of the casing; and a feeding wire that is connected to the logo mark through the hole formed in the casing.

According to another embodiment of the present disclosure, there is provided an electronic apparatus including: a casing that is formed of a non-conductive material and is configured such that a hole is formed in a part of the casing; a logo mark that is configured such that at least a part of the logo mark is formed of a conductor, the logo mark is disposed to cover the hole of the casing, a part of a conductor portion is exposed to the hole of the casing, and the conductor portion serves as an antenna element; and a feeding wire that is connected to the logo mark through the hole formed in the casing.

According to still another embodiment of the present disclosure, there is provided an electronic apparatus including: a casing that is formed of a non-conductive material and is configured such that a hole is formed in a part of the casing; an antenna element that is formed on an outer surface of the casing; a feeding wire that is wired through the hole of the casing from an inside of the casing and is formed to feed power to the antenna element; and a logo mark that is formed of a non-conductor and is disposed to cover the hole of the casing.

According to the embodiments of the present disclosure described above, it is possible to reduce a manufacturing cost without deterioration in the appearance of an antenna portion.

DETAILED DESCRIPTION OF THE EMBODIMENTS

Figure 1:
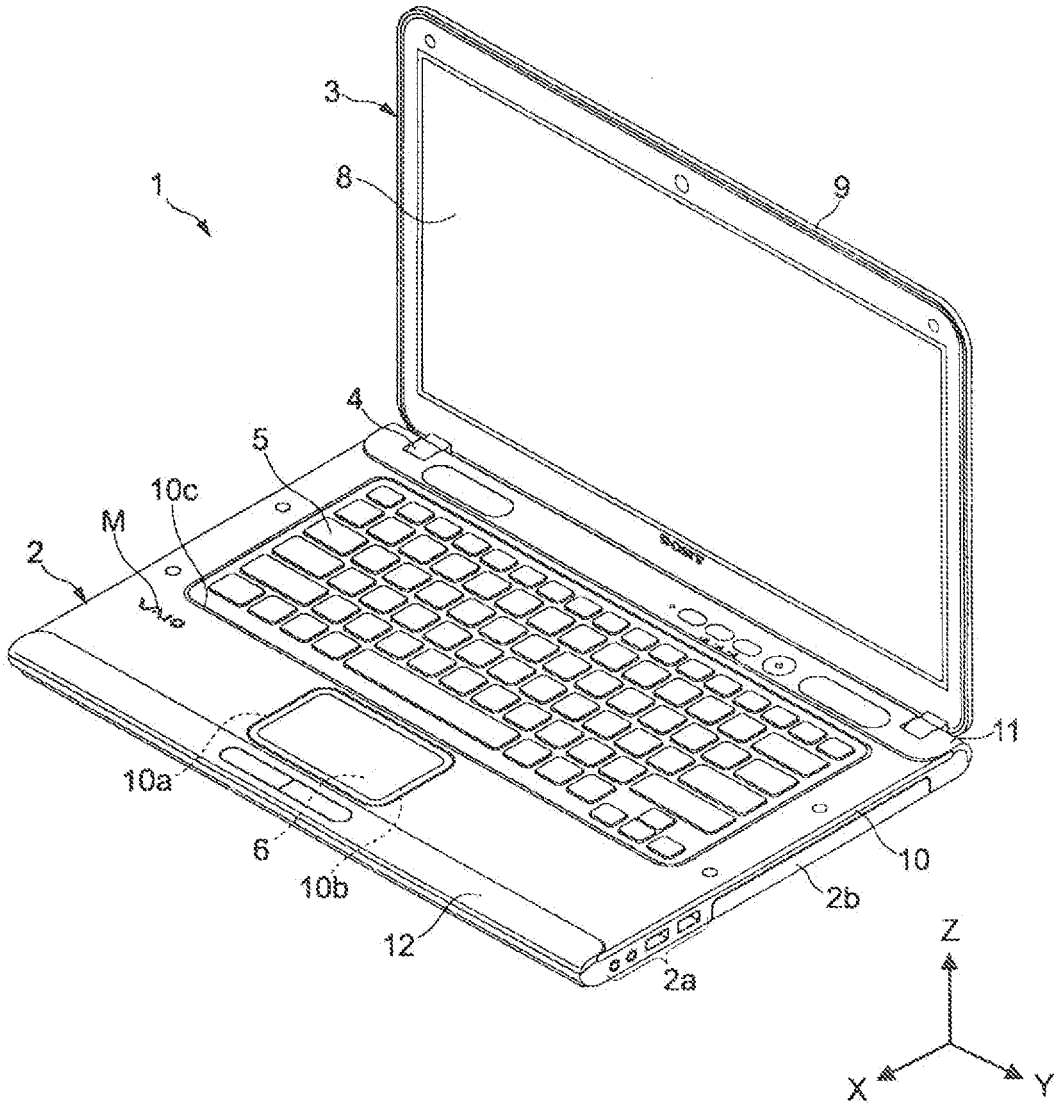
FIG. 1 is a diagram illustrating an exemplary configuration of an electronic apparatus according to an embodiment.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Flow of Description

The flow of this description will be described in brief below.

First, the review of structures in which a feeding wire is connected to an antenna element will be described with reference to FIGS. 8 to 11. Next, an exemplary configuration of an electronic apparatus 1 to which structures of an embodiment devised based on the review result can be applied will be described with reference to FIGS. 1 and 2. Next, the structure of an antenna installation portion according to the embodiment when a logo M is formed of a metal material will be described in detail with reference to FIGS. 3 to 5. Next, the structure of an antenna installation portion according to the embodiment when a logo M is formed of a non metal material will be described in detail with reference to FIGS. 6 and 7.

Finally, the technical spirit and essence of the embodiment will be summarized and the operations and advantages obtained from the technical spirit and essence of the embodiment will be described in brief.

Description Articles

1. Introduction
2. Embodiment
2-1. Exemplary Configuration of Electronic Apparatus 1
2-2. Structure #1 of Antenna Installation Portion (Metal Logo)
2-2-1. Exemplary Configuration A (Logo≠Antenna)
2-2-2. Exemplary Configuration B (Logo=Antenna)
2-3. Structure #2 of Antenna Installation Portion (Non-Metal Logo)
2-3-1. Exemplary Configuration C (Direct Wiring)
2-3-2. Exemplary Configuration D (Metal Layer)
3. Summarization 1. Introduction First, configurations of a feeding path for feeding power from a power source disposed inside a casing to an antenna element and the review result of usability and problems of the configurations will be described.

Figure 8:
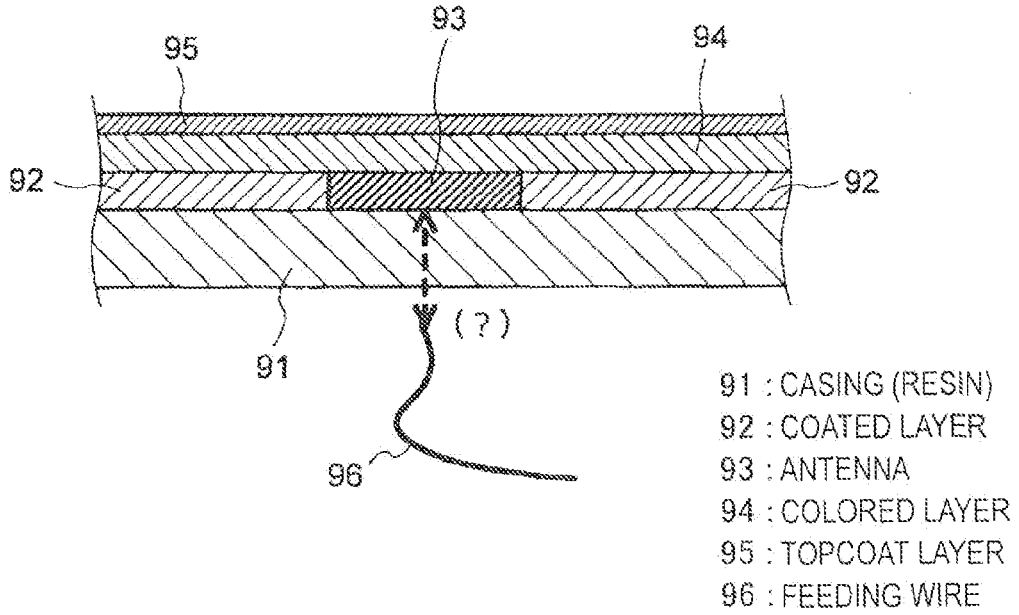
FIG. 8 is a diagram illustrating a review of a connection configuration of a feeding wire.

As shown in FIG. 8, a coated layer 92, an antenna 93, a colored layer 94, a topcoat layer 95, and the like are laminated on the outer surface of a casing 91 formed of a non-conductor such as a synthetic resin. Thus, the configuration in which the antenna 93 is installed on the outside of the casing 91 contributes to miniaturization, of the casing 91 and an improvement in an antenna performance. The antenna 93 is formed through coating or insert molding of a film that has an antenna pattern therein. A decorative layer configured by the coated layer 92, the colored layer 94, and the topcoat layer 95 is formed through coating or thermal transfer. Further, in a case of film inserting, a process of forming the antenna 93 and a process of forming the decorative layer are simultaneously performed.

Figure 9:
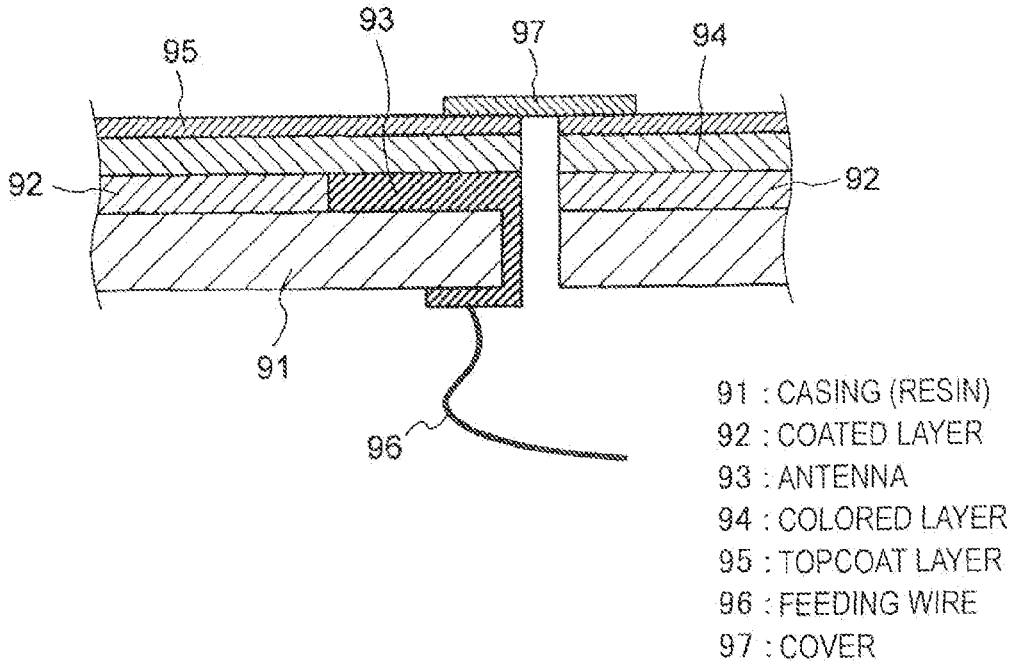
FIG. 9 is a diagram illustrating a review of a connection configuration of a feeding wire.

Hereinafter, a feeding path to the antenna 93 will be considered. As shown in FIG. 8, a power source (not shown) that supplies a current to the antenna 93 and a feeding wire 96 that forms a feeding path are wired inside the casing 91. Therefore, it is necessary to electrically connect the feeding wire 96 drawn from the power source to the antenna 93. For example, as shown in FIG. 9, a method of forming a hole in the casing 91 and drawing a part of the antenna 93 into the inside of the casing 91 may be considered as a method of electrically connecting the feeding wire 96 to the antenna. 93. When this method is applied, the part of the antenna 93 is drawn into the casing 91. Therefore, the feeding wire 96 can be easily connected to the antenna 93. However, since the hole is formed in the casing 91, it is necessary to provide a cover 97 in order to hide the hole. Further, since the antenna 93 is drawn up to the inside of the casing 91, a design and a manufacturing process may be complicated.

Figure 10:
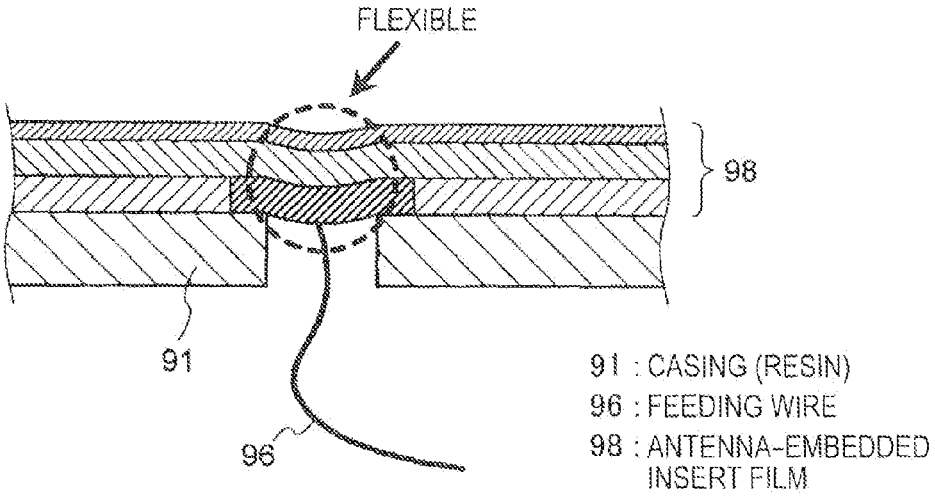
FIG. 10 is a diagram illustrating a review of a connection configuration of a feeding wire.

As shown in FIG. 10, it can be considered that a hole is formed in a casing 91 and an antenna-embedded insert film 98 such as an in-mold label (IML) is provided to cover the hole. In particular, since an antenna portion is disposed to be exposed to the hole of the casing 91 and a feeding wire 96 is inserted from the hole of the casing 91, the feeding wire 96 can be easily connected to the antenna portion. However, there is a probability that the antenna-embedded insert film 98 may be flexible in the portion of the hole formed in the casing 91 and thus the appearance may seem uneven. Further, since a connection portion between the antenna portion and the feeding wire 96 is supported only by the antenna-embedded insert film 98, the strength may be unavoidably deficient.

Figure 11:
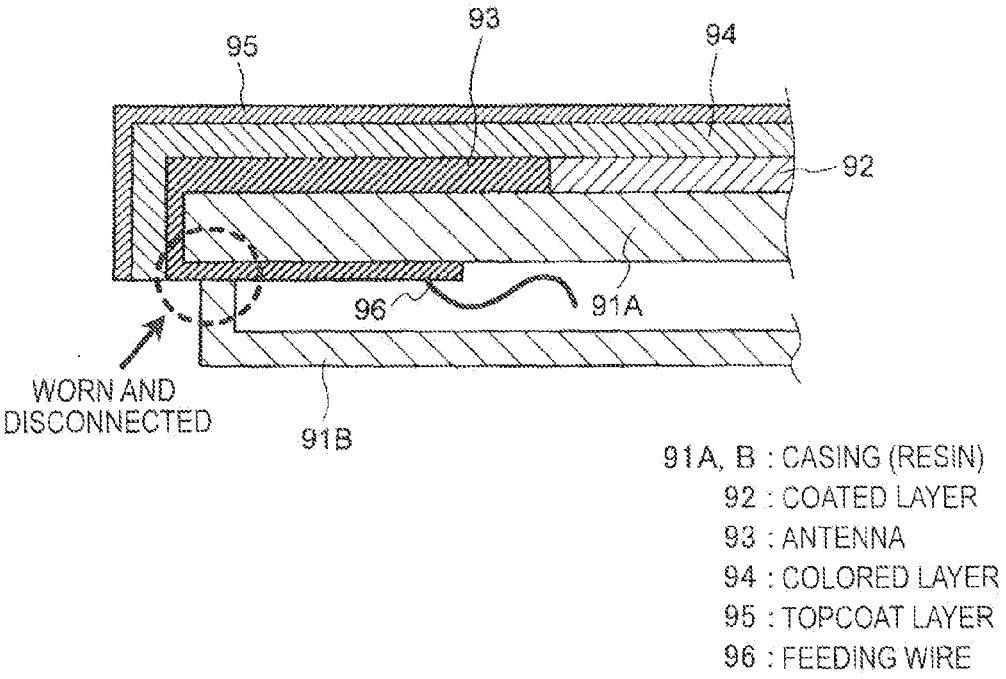
FIG. 11 is a diagram illustrating a review of a connection configuration of a feeding wire.

As shown in FIG. 11, an antenna 93 can be considered to be wrapped around the outer circumference of a casing 91A and drawn into the casing surrounded by the casing 91A and a casing 91B. Then, when this structure is applied, it is not necessary to form a hole in the casing 91A and the appearance can thus be finished satisfactorily. However, since a part of the antenna 93 is interposed in the connection portion between the casings 91A and 91B, there is a concern that the part of the antenna 93 may be worn and disconnected. Further, since it is necessary to extend the part of the antenna 93, a design and a manufacturing process may be complicated. Furthermore, a material cost may increase in proportion to the extension of the antenna 93. For example, a method of devising the shape of a hole or a method of supplying power to the antenna 93 through electromagnetic induction can be considered. However, there is a concern that the design may become complicated and the manufacturing cost may increase.

The various configurations have been examined, and configurations for which the manufacturing cost can be reduced without deterioration in the appearance by forming a logo on the outer surface of a casing have been devised consequently. When the configurations to be described in an embodiment are applied, the number of elements to be used can be reduced, a wire can be simply hidden, and decoration can be facilitated. Of course, the wire in the structure shown in FIG. 11 is not worn and disconnected and reliability can be also improved.

2. Embodiment

Hereinafter, an embodiment of the present disclosure will be described.

2-1. Exemplary Configuration of Electronic Apparatus 1

Figure 2:
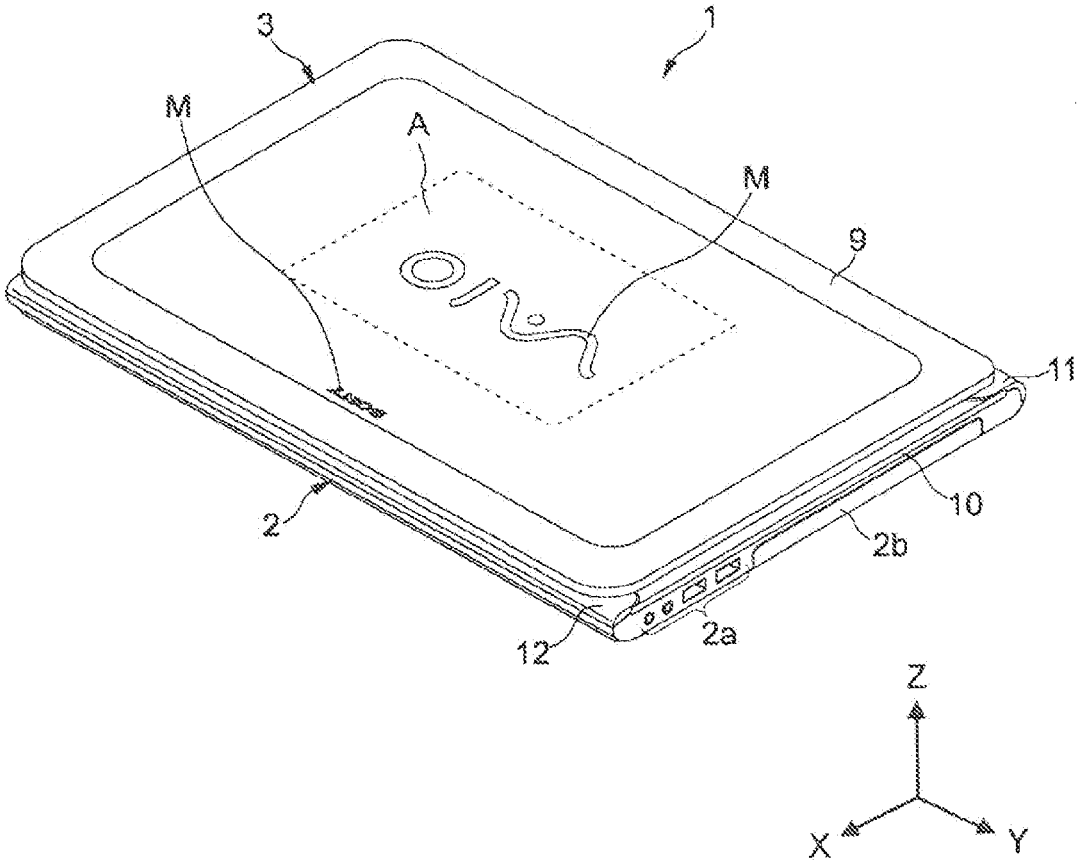
FIG. 2 is a diagram illustrating the exemplary configuration of the electronic apparatus according to the embodiment.

First, an exemplary configuration of an electronic apparatus 1 according to the embodiment will be described with reference to FIGS. 1 and 2, FIGS. 1 and 2 are diagrams illustrating the exemplary configuration of the electronic apparatus 1 according to this embodiment. In FIGS. 1 and 2, the outer appearance of a notebook-type personal computer is shown as the exemplary configuration of the electronic apparatus 1, but the application scope of the embodiment of the present disclosure is not limited thereto. For example, the embodiment is applicable to a portable telephone, a game console, an information terminal, an information appliance, a radio base station, a radio communication terminal, a television receiver, a set-top box, a recording and reproducing apparatus, an imaging apparatus, a car navigation system, and the like. However, to facilitate the description, the outer appearance of the electronic apparatus 1 exemplified in FIGS. 1 and 2 will be described below.

As shown in FIG. 1, the electronic apparatus 1 includes a body unit 2, a display unit 3, and a hinge unit 4. The hinge unit 4 connects the body unit 2 to the display unit 3. The display unit 3 can be opened or closed when the hinge unit 4 is pivoted. The body unit 2 includes an input device such as a keyboard 5 or a touch pad 6. The body unit 2 is covered with body covers 10, 11, and 12. The display unit 3 includes a display 8 and a display cabinet 9. For example, a liquid crystal display or an organic electro-luminescence (EL) display is used as the display 8. The display cabinet 9 is formed of, for example, a synthetic resin.

Members such as an antenna 23 to be described below are formed inside the display cabinet 9. The antenna 23 is used when radio communication is performed based on a communication scheme such as Bluetooth (registered trademark), wireless LAN, wireless WAN, WiMAX, UWB, or GPS or a portable telephone communication scheme. Further, "LAN" above is an abbreviation for "Local Area Network." "WAN" above is an abbreviation for "Wide Area Network," "WiMAX" above is an abbreviation for "Worldwide Interoperability for Microwave Access." "UWB" above is an abbreviation for "Ultra Wide Band." "GPS" above is an abbreviation for "Global Positioning System." In order to perform communication in accordance with the communication standard, a radio communication module (not shown) conforming to the communication standard is mounted on the electronic apparatus 1.

As shown in FIG. 2, logos M are formed on the outer surface of the display cabinet 9. In the example of FIG. 2, two logos M are formed on the outer surface of the display cabinet 9, but the number of logos M is not limited to two. For example, one logo M may be formed, or three or more logos M may be formed on the outer surface of the display cabinet 9. As shown in FIG. 1, the logos M may be formed on the upper surface of the body cover 11 that covers the body unit 2. That is, the position at which the logos M are formed is not limited to the outer surface of the display cabinet 9. However, to facilitate the description, the logos M (in particular, the logo M formed in a region A shown in FIG. 2) formed on the outer surface of the display cabinet 9 will be mainly described below.

The exemplary configuration of the electronic apparatus 1 according to the embodiment of the present disclosure has been described. In this embodiment, a structure of a region in which the antenna 23 is formed is characteristic. Thus, the characteristic structure will be described in detail below. However, to facilitate the description, the antenna 23 formed in the region A and the logo M will be mainly described on the assumption that the antenna 23 is formed in the region A shown in FIG. 2. Of course, the position at which the antenna 23 is formed or the shape of the logo M is not limited to the configuration exemplified in FIG. 2.

2-2. Structure #1 of Antenna Installation Portion (Metal Logo)

First, the structure of an antenna installation portion will be described in detail when the logos M of interest are formed of a metal material. Only a part of the logo M may be formed of a metal material. However, the description will be made on the assumption that the entire logos M are formed of a metal material.

2-2-1. Exemplary Configuration A (Logo≠Antenna)

Figure 3:
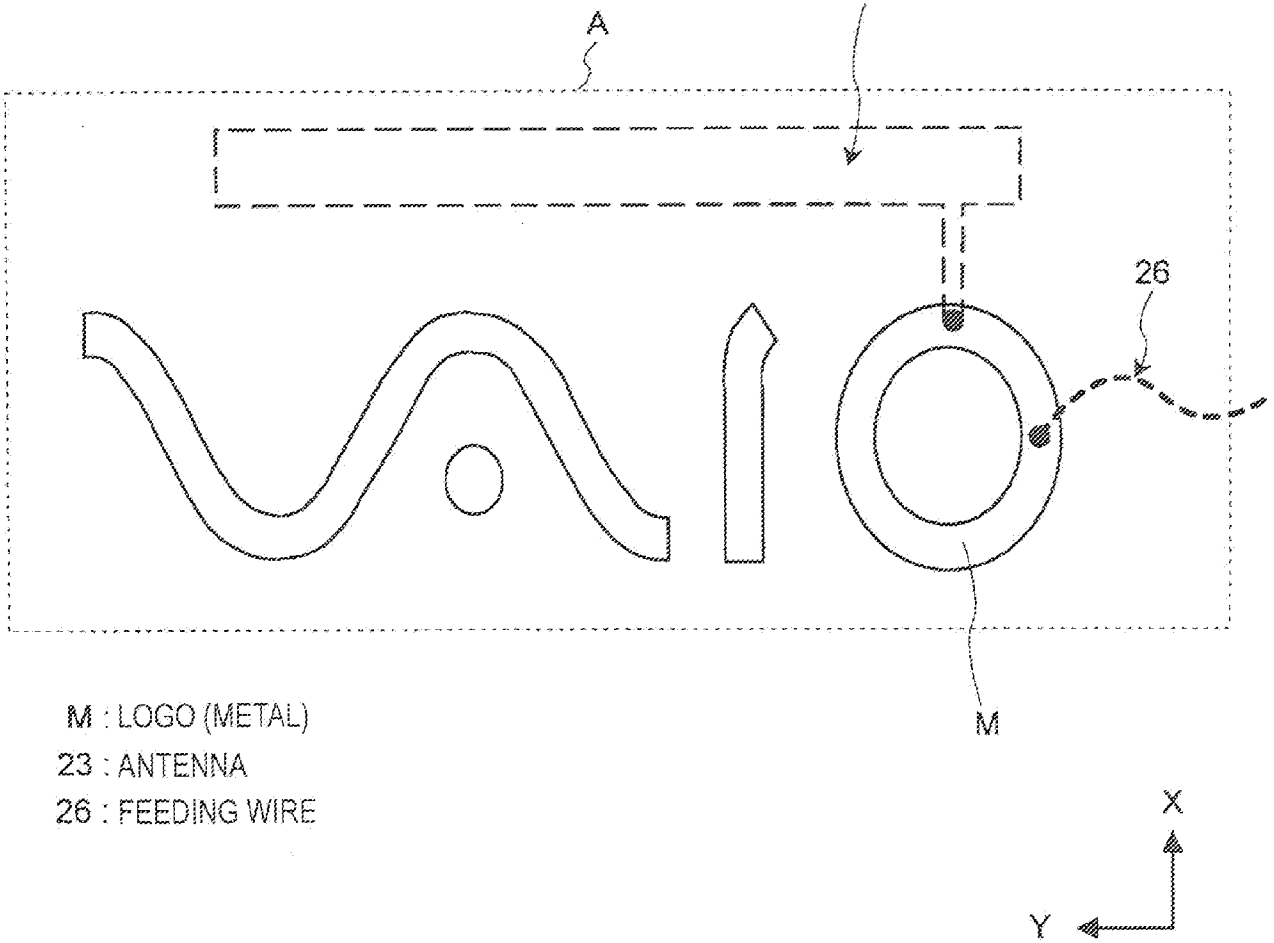
FIG. 3 is a diagram illustrating an exemplary configuration of an antenna of the electronic apparatus and an example of wiring of a feeding wire according to the embodiment.

The description will be made with reference to FIG. 3. HG 3 is a diagram schematically illustrating a configuration (hereinafter referred to as exemplary configuration A) in which an antenna 23, a feeding wire 26, and a logo M are disposed in the region A shown in FIG. 2. As shown in FIG. 3, the antenna 23 and the feeding wire 26 are connected to the logo M in the electronic apparatus 1 according to this embodiment. The logo M is formed of a metal material. Therefore, even when the feeding power 26 and the antenna 23 are not connected directly to each other, a current supplied through the feeding wire 26 is supplied to the antenna 23 through the logo M. In this configuration, a path in which the antenna 23 and the feeding wire 26 are electrically connected to each other can be simplified or a process of connecting the feeding wire 26 can be simplified. Hereinafter, a structural property of a portion in which the antenna 23, the logo M, and the feeding wire 26 are formed will be described in more detail with reference to FIG. 4.

Figure 4:
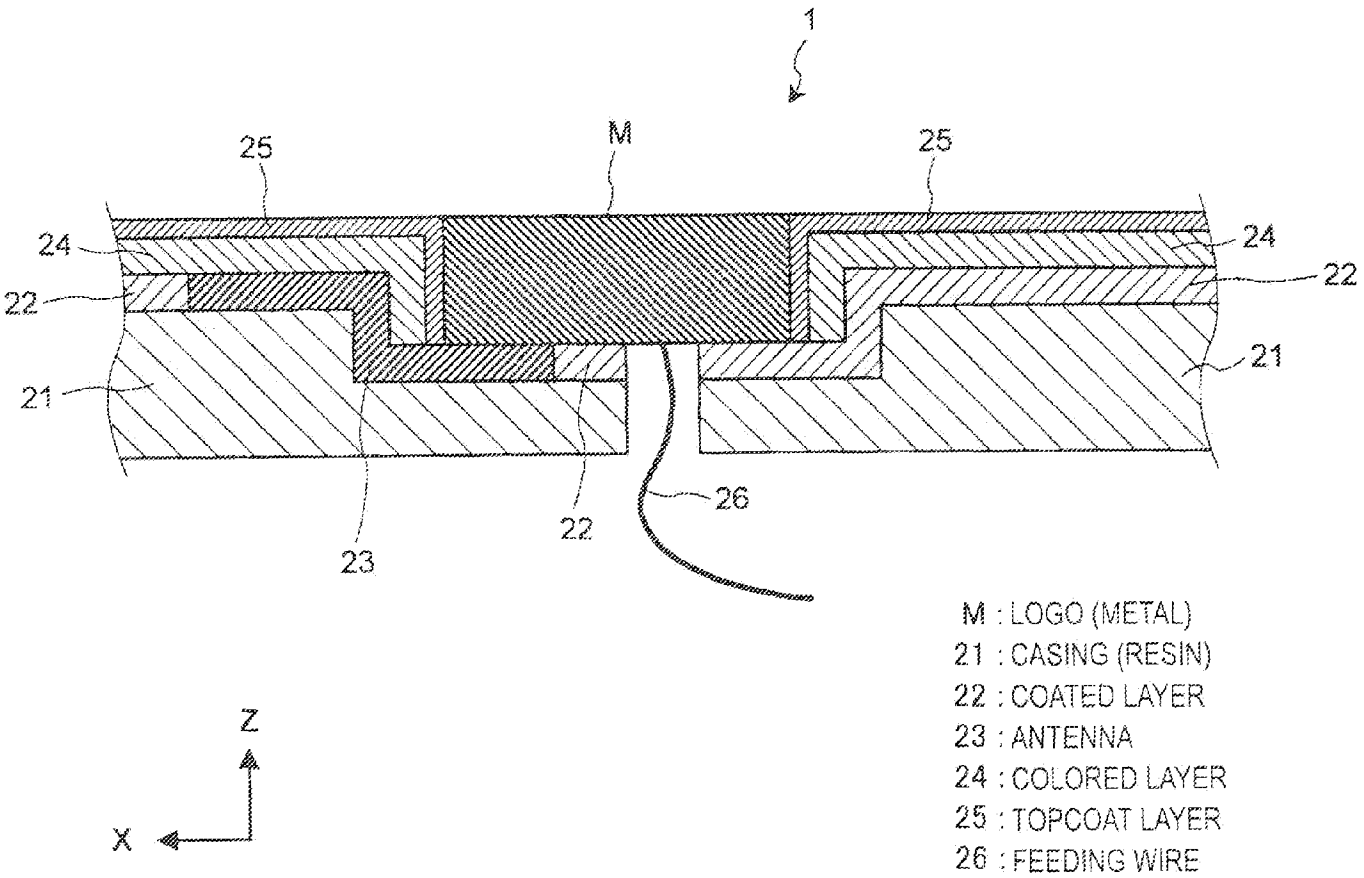
FIG. 4 is a diagram illustrating an exemplary structure of an antenna installation portion of the electronic apparatus according to the embodiment.

FIG. 4 is a sectional view taken along the X-Z surface in the region in which the antenna 23 and the logo M are disposed. As shown in FIG. 4, a coated layer 22, the antenna 23, a colored layer 24, a topcoat layer 25, and the logo M are laminated on a casing 21 of the electronic apparatus 1. A hole is formed in a part of the casing 21 and the logo M is formed to cover the hole. Therefore, a part of the logo M is exposed inside the casing 21 through the hole.

The feeding wire 26 wired from the inside of the casing 21 is connected to the logo M through the hole formed in the casing 21. Thus, since a part of the logo M is exposed inside the casing 21 through the hole of the casing 21, the feeding wire 26 is easily wired. As shown in FIG. 4, the part of the logo M comes into contact with the antenna 23. Thus, the logo M is electrically connected to the antenna 23. Accordingly, when a current flows to the feeding wire 26, the current is fed to the antenna 23 through the logo M.

Next, the configuration of each layer will be described in more detail.

The casing 21 is formed of a non-conductive material such as a synthetic resin. The antenna 23 is formed on the outer surface of the casing 21. The antenna 23 is formed of a metal material having a conductive property, such as aluminum, gold, silver, iron, copper, or nickel. The antenna 23 is formed in a thin film shape on the outer surface of the casing 21 by, for example, vacuum deposition, screen printing, spray coating, sputtering, or plating. The coated layer 22 having substantially the same thickness as the antenna 23 is formed on the outer surface of the casing 21 so as not to cover the hole of the casing 21.

The logo M is formed on the upper surface of a base layer, which is configured by the antenna 23 and the coated layer 22, and is disposed to cover the hole of the casing 21. A part of the logo M come into contact with the antenna 23 and a part of the logo M is disposed to be exposed to the hole of the casing 21. The logo M is formed of a metal material having a conductive property, such as aluminum, gold, iron, copper, or nickel. Further, the colored layer 24 is formed on the upper surface of the base layer on which the logo M is not placed. The topcoat layer 25 is formed on the surface of the colored layer 24. The topcoat layer 25 is a layer that protects each layer. The topcoat layer 25 is formed of a material such as acrylic or polyurethane. The coated layer 22, the colored layer 24, and the topcoat layer 25 are formed by, for example, screen printing, in-mold design (IMD), or in-mould forming (IMF).

The thickness of each of the coated layer 22, the antenna 23, the colored layer 24, and the topcoat layer 25 is in the range of about 10 μm to about 30 μm. On the other hand, the thickness of the logo M is in the range of about 50 μm to about 300 μm. The thickness of the logo M is greater than the thickness of a decorative layer that is configured by the coated layer 22, the colored layer 24, and the topcoat layer 25. Accordingly, the strength of the logo M is higher than the strength of the decorative layer. Since the hole of the casing 21 is covered with the logo M, a portion in which the hole of the casing 21 is formed is not flexible. Further, since the logo M has a sufficient thickness, the connection portion of the feeding wire 26 and the logo M is hidden from the outside. Therefore, even when a special structure is not formed to hide the connection portion, a good appearance can be realized. Thus, by using the logo M having the greater thickness than the other layers as the feeding wire, the feeding wire 26 can be easily connected, the sufficient strength can be ensured, and a good appearance can be realized.

Exemplary configuration A has been described. Here, the configuration in which the logo M is used as the part of the feeding path has been described. However, when the logo M is formed of a metal material, the logo M itself may be considered to be used as an antenna element. Hereinafter, this configuration will be described.

2-2-2. Exemplary Configuration B (Logo=Antenna)

Figure 5:
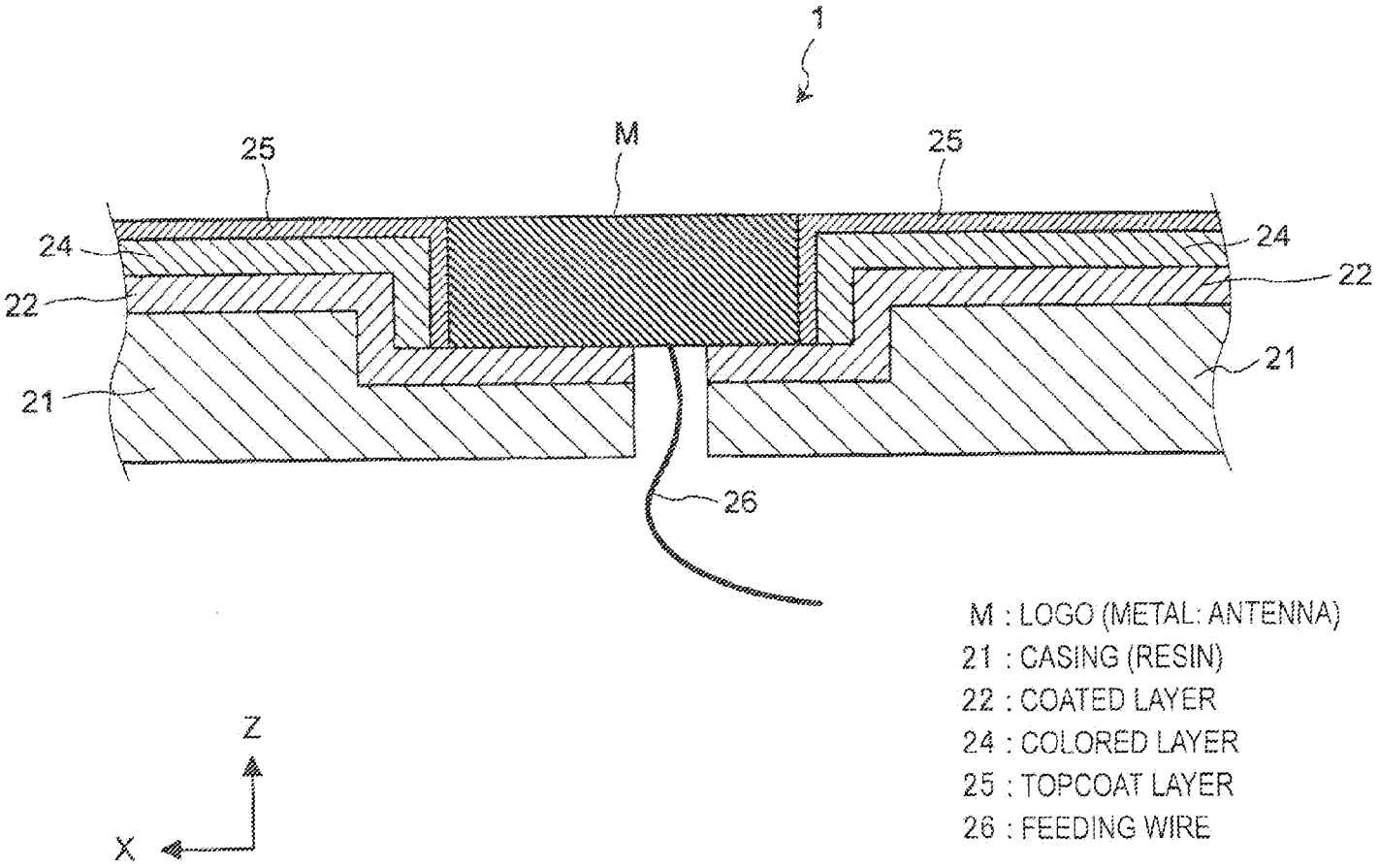
FIG. 5 is a diagram illustrating an exemplary structure of an antenna installation portion of the electronic apparatus according to the embodiment.

The description will be made with reference to FIG. 5. FIG. 5 is a diagram schematically illustrating a configuration (hereinafter referred to as exemplary configuration B) in which a feeding wire 26 and the logo M are disposed in the area A shown in FIG. 2. As shown in FIG. 5, the feeding wire 26 is connected to the logo M formed of a metal material in the electronic apparatus 1 according to this embodiment. A current supplied through the feeding wire 26 is supplied to the logo M. In exemplary configuration B, the logo M functions as an antenna element. Therefore, it is not necessary to provide a separate antenna element. Exemplary configuration B is the same as exemplary configuration A described above in that the feeding path can be simplified and a process of connecting the feeding wire 26 can be simplified. Further, since the configuration of the coated layer 22, the colored layer 24, and the topcoat layer 25 and the disposition of the logo M are the same as those of exemplary configuration A described above, the detailed description thereof will not be repeated.

Exemplary configuration 13 has been described. A process of forming the coated layer 22 can be simplified by using the logo M as an antenna element, as in exemplary configuration B. Further, since it is not necessary to provide a separate antenna element, the number of elements can be reduced. As a result, the manufacturing cost can be further reduced, compared to exemplary configuration A described above. However, when control of the performance or directivity of an antenna is considered, realizing exemplary configuration A described above is more useful in some cases. Therefore, exemplary configuration A or exemplary configuration B is preferably selected depending on an embodiment.

2-3. Structure #2 of Antenna Installation Portion (Non-Metal Logo)

Next, the structure of an antenna installation portion will be described in detail, when the logos M of interest are formed of a non-metal material.

2-3-1. Exemplary Configuration C (Direct Wiring)

Figure 6:
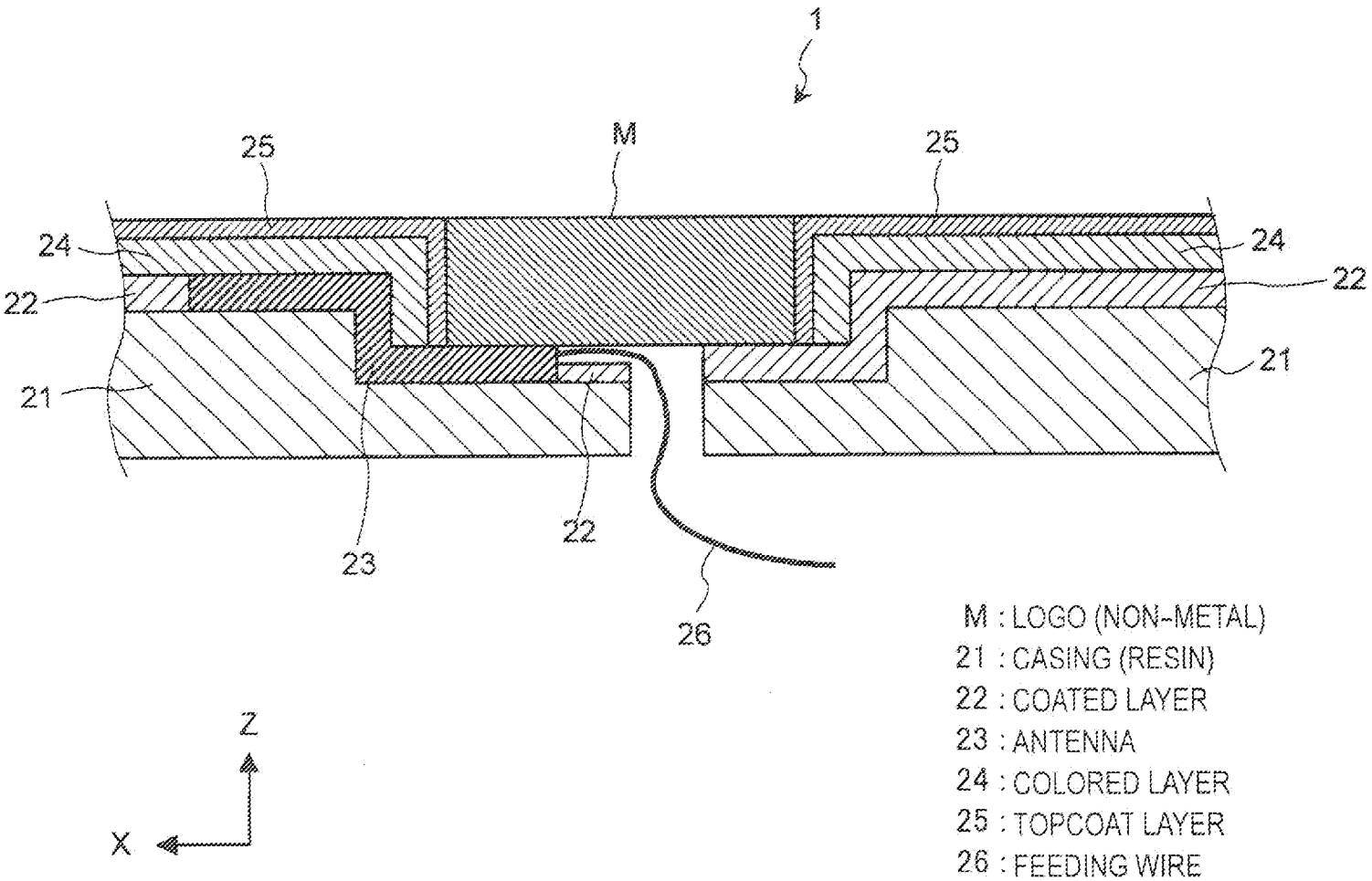
FIG. 6 is a diagram illustrating an exemplary structure of an antenna installation portion of the electronic apparatus according to the embodiment.

The description will be made with reference to FIG. 6. FIG. 6 is a diagram schematically illustrating a configuration (hereinafter referred to as exemplary configuration C) in which an antenna 23, a feeding wire 26, and a logo NI are disposed in the region A shown in FIG. 2. In exemplary configuration C, the logo M is formed of a non-metal material such as a synthetic resin. As shown in FIG. 6, a gap in which the feeding wire 26 is wired is formed below the logo M in the electronic apparatus 1 according to this embodiment. A part of the antenna 23 is exposed to the gap. The feeding wire 26 inserted through a hole of the casing 21 is connected to the part of the antenna 23 exposed to the gap.

Next, the configuration of each layer will be described in more detail.

The casing 21 is formed of a non-conductive material such as a synthetic resin. The antenna 23 is formed on the outer surface of the casing 21. The antenna 23 is formed of a metal material having a conductive property, such as aluminum, gold, iron, copper, or nickel. The antenna 23 is termed in a thin film shape on the outer surface of the casing 21 by, for example, vacuum deposition, screen printing, spray coating, sputtering, or plating. The coated layer 22 having substantially the same thickness as the antenna 23 is formed on the outer surface of the casing 21 so as not to cover the hole of the casing 21. However, in the coated layer 22 located below the logo M, a portion coming into contact with the antenna 23 is formed thinner than the antenna 23 or is not formed. In this configuration, a gap in which the feeding wire 26 can be wired is formed below the logo M.

The logo M is supported by a part of a base layer, which is configured by the antenna 23 and the coated layer 22, and is disposed to cover the hole of the casing 21. Further, a colored layer 24 is formed on the upper surface of the base layer on which the logo M is not placed. A topcoat layer 25 is formed on the surface of the colored layer 24. The topcoat layer 25 is a layer that protects each layer. The topcoat layer 25 is formed of a material such as acrylic or polyurethane. The coated layer 22, the colored layer 24, and the topcoat layer 25 are formed by, for example, screen printing, IMD, or IMF.

The thickness of each of the coated layer 22, the antenna 23, the colored layer 24, and the topcoat layer 25 is in the range of about 10 μm to about 30 μm. On the other hand, the thickness of the logo M is in the range of about 50 μm to about 300 μm. The thickness of the logo M is greater than the thickness of a decorative layer that is configured by the coated layer 22, the colored layer 24, and the topcoat layer 25. Therefore, since the hole of the casing 21 is covered with the logo M, a portion in which the hole of the casing 21 is formed is not flexible. Further, since the logo M has a sufficient thickness, the connection portion of the feeding wire 26 and the logo M is hidden from the outside. Therefore, even when a special structure is not formed to hide the connection portion, a good appearance can be realized. Thus, by covering the hole of the casing 21 with the logo M having the greater thickness than the other layers, the sufficient strength can be ensured and a good appearance can be realized.

Exemplary configuration C has been described. Here, the configuration in which the feeding wire 26 is wired below the logo M has been described, but the method of forming the feeding path is not limited thereto. Hereinafter, a method of forming a metal layer on the lower surfaces of the logo M and using the metal layer as a feeding path will be described as an example of the method of forming the feeding path.

2-3-2 Exemplary Configuration D (Metal Layer)

Figure 7:
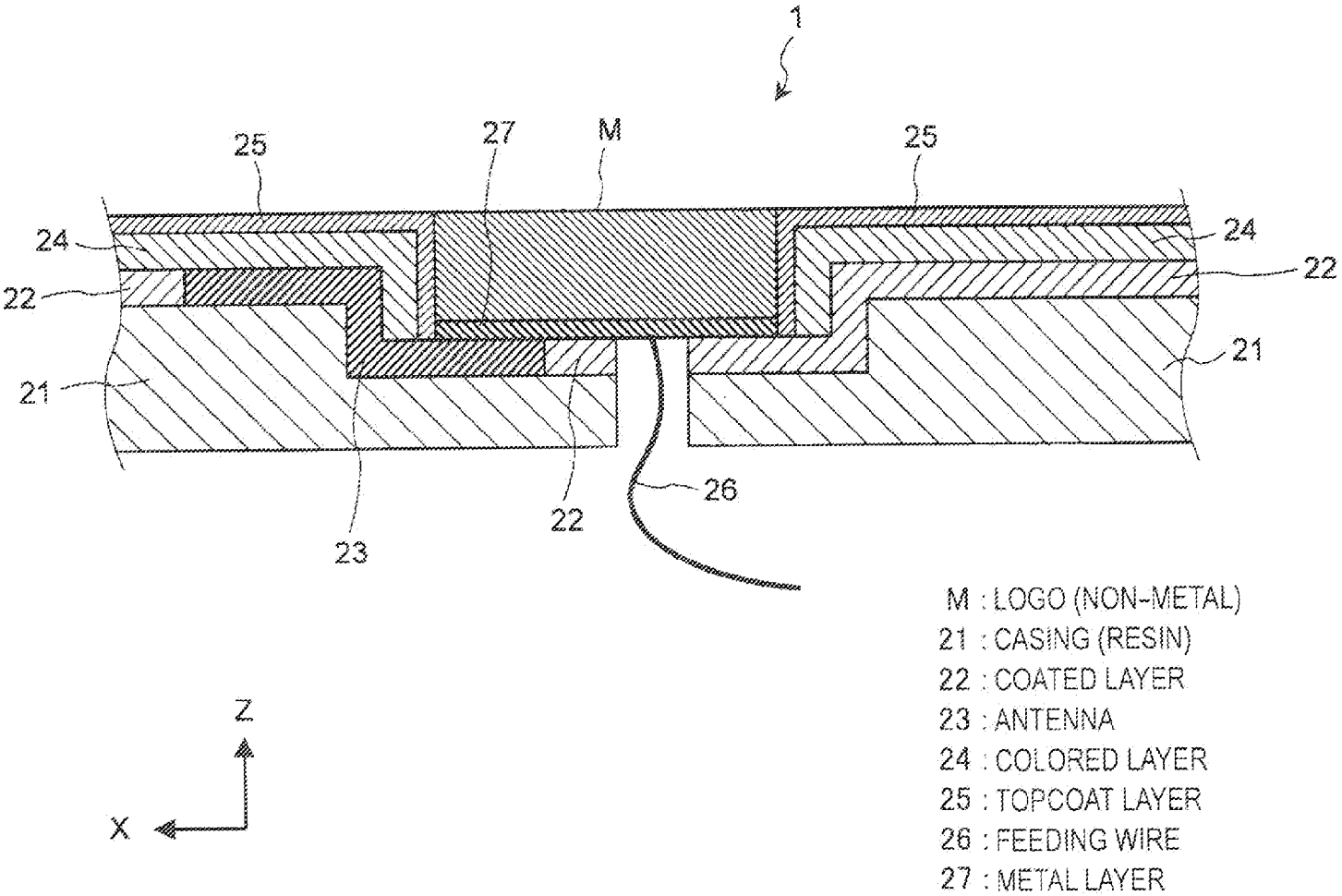
FIG. 7 is a diagram illustrating an exemplary structure of an antenna installation portion of the electronic apparatus according to the embodiment.

The description will be made with reference to FIG. 7, FIG. 7 is a diagram schematically illustrating a configuration (hereinafter referred to as exemplary configuration D) in which an antenna 23, a feeding wire 26, and the logo M are disposed in the area A shown in FIG. 2. In exemplary configuration D, the logo M is formed of a non-metal material such as a synthetic resin. As shown in FIG. 7, a metal layer 27 is owed on the lower surface of the logo M in the electronic apparatus 1 according to this embodiment. The metal layer 27 is formed of a metal material having a conductive property, such as aluminum, gold, iron, copper, or nickel. The metal layer 27 is formed in a thin film shape on the lower surface of the logo M by, for example, vacuum deposition, screen printing, spray coating, sputtering, or plating.

The feeding wire 26 is connected to the metal layer 27. Further, the metal layer 27 is disposed to come into contact with the antenna 23. Therefore, even when the feeding wire 26 does not come into direct contact with the antenna 23, a current supplied through the feeding wire 26 is supplied to the antenna 23 through the metal layer 27. In this configuration, a path in which the antenna 23 and the feeding wire 26 are electrically connected to each other can be simplified or a process of connecting the feeding wire 26 can be simplified. Hereinafter, a structural property of a portion in which the antenna 23, the metal layer 27, the logo M, and the feeding wire 26 are formed will be described in more detail with reference to FIG. 7.

FIG. 7 is a sectional view taken along the X-Z surface in the region in which the antenna 23 and the logo M are disposed. As shown in FIG. 7, a coated layer 22, the antenna 23, a colored layer 24, a topcoat layer 25, the metal layer 27, and the logo M are laminated on a casing 21 of the electronic apparatus 1. A hole is formed in a part of the casing 21 and the logo M is formed to cover the hole. The metal layer 27 is formed on the lower surface of the logo M. Therefore, a part of the metal layer 27 is exposed inside the casing 21 through the hole.

The feeding wire 26 wired from the inside of the casing 21 is connected to the metal layer 27 through the hole formed in the casing 21. Thus, since a part of the metal layer 27 formed on the lower surfaces of the logo M is exposed inside the casing 21 through the hole of the casing 21, the feeding wire 26 is easily wired. As shown in FIG. 7, the part of the metal layer 27 formed on the lower surfaces of the logo M comes into contact with the antenna 23. Thus, the metal layer 27 is electrically connected to the antenna 23. Accordingly, when a current flows to the feeding wire 26, the current is fed to the antenna 23 through the metal layer 27.

The configuration of the coated layer 22, the antenna 23, the colored layer 24, and the topcoat layer 25 is the same as exemplary configuration A described above. However, in the case of exemplary configuration D, the total thickness of the logo M and the metal layer 27 may be sufficiently greater than the thickness of the decorative layer. For example, the total thickness of the logo M and the metal layer 27 is set to be in the range of about 50 μm to about 300 μm, in the case of exemplary configuration D, since the hole of the casing 21 is covered with the logo M having the sufficient thickness, a portion in which the hole of the casing 21 is formed is not flexible. Further, the connection portion of the feeding wire 26 is hidden from the outside. Therefore, even when a special structure is not formed to hide the connection portion, a good appearance can be realized. Thus, the feeding wire 26 can be easily connected, the sufficient strength can be ensured, and a good appearance can be realized.

Exemplary configuration D has been described. Here, the configuration in which the metal layer 27 formed on the lower surface of the logo M is used as a part of the feeding path has been described. However, for example, a configuration in which the metal layer 27 formed on the lower surface of the logo M is used as an antenna element can be considered. When the metal layer 27 is used as the antenna element, the degree of design freedom of the shape of the logo M is further improved. Therefore, by forming the metal layer 27 in a pattern of higher antenna performance, high communication performance can be realized.

The embodiment of the present disclosure has been described.

3. Summarization

Finally, the technical spirit and essence of this embodiment will be summarized in brief. The technical spirit and essence to be described below are applicable to antennal installation portions of various electronic apparatuses such as a PC, a portable telephone, a game console, an information terminal, an information appliance, a radio base station, a radio communication terminal, a television receiver, a set-top box, a recording and reproducing apparatus, an imaging apparatus, and a car navigation system.

The configuration of an electronic apparatus according to the embodiment can be expressed as follows. For example, in an electronic apparatus described below in (1), a conductive portion of a logo mark is used as a conductive path. The electronic apparatus has a configuration in which a conductor portion of the logo mark is exposed to a hole of the casing and a feeding wire is connected to the exposed portion. Therefore, the feeding wire can be easily connected. Further, it is not necessary to provide a complicated mechanism that draws an antenna element to the outside and connects the antenna element to the feeding wire. As a result, the manufacturing cost can be reduced.

Since the hole of the casing is covered with the logo mark, it is possible to obtain the advantage of clearly hiding the connection portion of the feeding wire and realizing the good appearance. Further, since the hole of the casing is covered with the logo mark with the strength higher than the decorative layer, the portion in which the hole of the casing is formed can be prevented from being flexible. For these reasons, the manufacturing cost can be reduced without deterioration in the appearance of the antenna installation portion, when the configuration to be described below in (1) is applied. Further, electronic apparatuses to be described below in (2) and (3) are devised to easily connect the feeding wire without deterioration in the appearance. Accordingly, as in the configuration to be described below in (1), the manufacturing cost can be reduced without deterioration in the appearance of the antenna installation portion.

(1) An electronic apparatus including:

a casing that is formed of a non-conductive material and is configured such that a hole is formed in a part of the casing;

an antenna element that is formed on an outer surface of the casing;

a logo mark that is configured such that at least a part thereof is formed of a conductor to be disposed to cover the hole of the casing, a part of a conductor portion comes into contact with the antenna element, and another part of the conductor portion is exposed to the hole of the casing; and a feeding wire that is connected to the logo mark through the hole formed in the casing.

(2) An electronic apparatus including:

a casing that is formed of a non-conductive material and is configured such that a hole is formed in a part of the casing;

a logo mark that is configured such that at least a part thereof is formed of a conductor to be disposed to cover the hole of the casing, a part of a conductor portion is exposed to the hole of the casing, and the conductor portion serves as an antenna element; and a feeding wire that is connected to the logo mark through the hole formed in the casing.

(3) An electronic apparatus including:

a casing that is formed of a non-conductive material and is configured such that a hole is formed in a part of the casing;

an antenna element that is formed on an outer surface of the casing;

a feeding wire that is wired through the hole of the casing from an inside of the casing and is formed to feed power to the antenna element; and a logo mark that is formed of a non-conductor and is disposed to cover the hole of the casing.

(4) The electronic apparatus according to (3), wherein the feeding wire is wired through a gap formed between the outer surface of the casing and one surface of the logo mark and is connected to a part of the antenna element exposed to the gap, (5) The electronic apparatus according to (3), further including:

a conductor layer that is formed of a conductor and is formed in a lower portion of the logo mark so that a part thereof comes into contact with the antenna element and another part thereof is exposed to the hole of the casing, wherein the feeding wire is connected to the conductor layer.

(6) The electronic apparatus according to any one of (1) to (5), further including:

a decorative layer that covers outer surfaces of the antenna element and the casing, wherein a thickness of the logo mark is greater than that of the decorative layer.

(7) The electronic apparatus according to (6), wherein a strength of the logo mark is higher than that of the decorative layer.

(8) The electronic apparatus according to any one of (1) to (7), further including:

a radio communication module that is capable of performing radio communication with an external apparatus by controlling a feeding pattern to the feeding wire in accordance with a transmitted signal.

Remark

The antenna 23 described above is an example of the antenna element. The coated layer 22, the colored layer 24, and the topcoat layer 25 described above are an example of the decorative layer. The logo M described above is an example of the logo mark. The metal layer 27 described above is an example of the conductor layer.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2011-240120 filed in the Japan Patent Office on Nov. 1, 2011, the entire content of which is hereby incorporated by reference.

What is claimed is:

1. An electronic apparatus comprising:

a casing that is formed of a non-conductive material and is configured such that a hole is formed in a part of the casing;

an antenna element that is formed on an outer surface of the casing;

a decorative layer that covers outer surfaces of the antenna element and the casing, a logo mark that is configured such that at least a part thereof is formed of a conductor to be disposed to cover the hole of the casing, a part of a conductor portion comes into contact with the antenna element, and another part of the conductor portion is exposed to the hole of the casing, the logo mark having a thickness and strength greater than that of the decorative layer; and a feeding wire that is connected to the logo mark through the hole formed in the casing.

2. The electronic apparatus according to claim. 1, further comprising:

a radio communication module that is capable of performing radio communication with an external apparatus by controlling a feeding pattern to the feeding wire in accordance with a transmitted signal.

* * * * *